US010676891B2

(12) United States Patent
Dong

(10) Patent No.: US 10,676,891 B2
(45) Date of Patent: Jun. 9, 2020

(54) COUPLER FOR A WHEEL LOADER

(71) Applicant: VOLVO CONSTRUCTION EQUIPMENT AB, Eskilstuna (SE)

(72) Inventor: Yonghui Dong, Jinan (CN)

(73) Assignee: Volvo Construction Equipment AB (SE)

( * ) Notice: Subject to any disclaimer, the term of this patent is extended or adjusted under 35 U.S.C. 154(b) by 0 days.

(21) Appl. No.: 16/423,520

(22) Filed: May 28, 2019

(65) Prior Publication Data

US 2019/0277003 A1 Sep. 12, 2019

Related U.S. Application Data

(62) Division of application No. 15/129,027, filed as application No. PCT/CN2014/074212 on Mar. 27, 2014, now abandoned.

(51) Int. Cl.
*E02F 3/36* (2006.01)

(52) U.S. Cl.
CPC ..... *E02F 3/3609* (2013.01); *E02F 3/3631* (2013.01); *E02F 3/3636* (2013.01); *E02F 3/3668* (2013.01); *E02F 3/3672* (2013.01)

(58) Field of Classification Search
CPC .... A01B 59/062; E02F 3/3631; E02F 3/3636; E02F 3/364; E02F 3/3659; E02F 3/3663;
(Continued)

(56) References Cited

U.S. PATENT DOCUMENTS 4,096,957 A * 6/1978 Iverson ..... E02F 3/3604 403/154
6,227,792 B1 5/2001 Baker et al.
(Continued)

FOREIGN PATENT DOCUMENTS

CA 2731443 A1 8/2012
CN 1774547 A 5/2006
(Continued)

OTHER PUBLICATIONS

International Search Report for PCT/CN2014/074212, dated Dec. 8, 2014, ISA/CN.
(Continued)

*Primary Examiner* — Saul Rodriguez
*Assistant Examiner* — Brendan P Tighe
(74) *Attorney, Agent, or Firm* — Harness, Dickey & Pierce, P.L.C.

(57) ABSTRACT

A coupler for a wheel loader is disclosed. The coupler is used for coupling an attachment to a lifting arm of the wheel loader. A bracket is installed between the lifting arm and the attachment. The bracket's back face is pivotally connected to a lifting arm and the bracket's front face is detachably connected to the attachment. The attachment has a pair of protrusions rearwardly extending from the lower back of the attachment and have locking holes pierced through their width. The bracket has a pair of receiving slots formed at the lower front of the bracket and engaged with the protrusions. The coupler has a shaft, and a pair of locking pins combined with the shaft by threads. The threads formed at one end of the shaft are right handed and the threads formed at the other end of the shaft are left handed. When users turn the shaft in one direction, the locking pins are extended and engaged with the locking holes (a coupling position). When users turn the shaft in the other direction, the locking pins are shortened and released from the locking holes (a release position).

8 Claims, 5 Drawing Sheets

(58) Field of Classification Search
CPC ..... E02F 3/3668; E02F 3/3672; E02F 3/3609; Y10T 403/598
USPC ..... 37/468; 172/273; 403/324; 414/723
See application file for complete search history.

(56) References Cited

U.S. PATENT DOCUMENTS

| | | | | |
|---|---|---|---|---|
| 6,385,872 | B1 | 5/2002 | Mieger et al. | |
| 7,225,566 | B1 * | 6/2007 | Kimble | E02F 3/3627 37/403 |
| 7,814,689 | B2 | 10/2010 | Vering et al. | |
| 2006/0104789 | A1 * | 5/2006 | Vigholm | E02F 3/3631 414/733 |
| 2006/0245898 | A1 | 11/2006 | Diaz et al. | |
| 2007/0245603 | A1 | 10/2007 | Vering et al. | |
| 2009/0304486 | A1 | 12/2009 | Bricker et al. | |
| 2011/0280648 | A1 * | 11/2011 | Malacrino | A01B 59/062 403/31 |
| 2013/0045073 | A1 | 2/2013 | Bricker et al. | |

FOREIGN PATENT DOCUMENTS

| | | | |
|---|---|---|---|
| CN | 1865605 | A | 11/2006 |
| CN | 101449006 | A | 6/2009 |
| DE | 9315868 | U1 | 2/1995 |
| DE | 29708705 | U1 | 7/1997 |
| DE | 29909329 | U1 | 8/1999 |
| MX | 2010012166 | A | 5/2011 |
| WO | WO-2010084012 | A1 | 7/2010 |

OTHER PUBLICATIONS

Extended European Search Report dated Oct. 10, 2017 issued by the European Patent Office (EPO) regarding EP Application No. 14887157.7 (10 pages).

First Office Action dated Feb. 27, 2018 in corresponding Chinese Application No. 201480077585.5.

* cited by examiner

COUPLER FOR A WHEEL LOADER

CROSS-REFERENCE TO RELATED APPLICATIONS

This application is a divisional of U.S. patent application Ser. No. 15/129,027 filed on Sep. 26, 2016, which claimed the benefit and priority of International Application No. PCT/CN2014/074212 filed Mar. 27, 2014. The entire disclosures of each of the above applications are incorporated herein by reference.

FIELD

The present disclosure relates to a wheel loader, and more particularly, to an attachment coupler for a wheel loader.

BACKGROUND

Loaders have the facility for coupling and uncoupling an attachment with a lifting arm or for switching between various attachments such as a bucket, a clamp, or a fork.

A coupler is used to couple the attachment with the lifting arm. Hydraulically powered displaceable pins are generally used for the attachment coupler's locking. Namely, the attachment is guided so that the locking holes are situated in a position in which displaceable pins can be shot through them, following which these pins, guided by controls located in the operating station, are hydraulically activated and shot into the holes, thereby locking the attachment with the lifting arm.

The hydraulically powered locking enables relatively rapid change of attachments without leaving the operating site, but it requires various hydraulic components such as actuators, conduits and valves, thus making a complex structure. Also, the engine and the whole machine should be turned on since this hydraulic coupler depends upon existing machine hydraulics for activating the locking pins.

On the other hand, manual couplers are relatively simple in structure, but they require substantial efforts and time from users for coupling or uncoupling for each and every locking position between the bracket and the attachment.

SUMMARY

According to one aspect of the present disclosure, there provides a working machine, in this case a wheel loader which has a coupler for coupling an attachment to a lifting arm. A coupler is installed between the lifting arm and the attachments such as a bucket, a clamp or a fork. The bracket's back face is pivotally connected to the lifting arm and the bracket's front face is detachably connected to the attachment.

The attachment has a pair of protrusions rearwardly extending from the lower back of the attachment and laterally spaced apart from each other. The protrusions have locking holes pierced through their width. The bracket has a pair of receiving slots formed at the lower front of the bracket and engaged with the protrusions.

The coupler to lock the protrusions into the corresponding receiving slots comprises a shaft fixed to the bracket by means of fixtures and a pair of locking pins combined with the shaft by threads.

The shaft has threads formed at both ends. The threads formed at the one end of the shaft are right handed and the threads formed at the other end of the shaft are left handed. The locking pins are tubular, and inserted into the ends of the shaft, respectively. The internal surface of the first tubular locking pin has threads corresponding to the threads formed at the one end of the shaft. Likewise, the internal surface of the second tubular locking pins has threads corresponding to the threads formed at the other end of the shaft.

The locking pins are longitudinally divided into two parts, that is, a cylindrically cross-sectioned outer part and a non-cylindrically cross-sectioned inner part. The cross-section of the inner part can be partially flattened cylindrical shape or polygonal shape.

A pair of holders are provided to support each of the locking pins. The holders are fixed to the bracket. The contacting surface of the holder corresponds to the non-cylindrical contour of the inner part of the locking pin, thereby preventing the locking pin from being rotated when the shaft is driven to rotate. That is, the locking pins are rectilinearly moved due to a thread interaction when the shaft rotates.

When users turn the shaft in one direction, for example clockwise, locking pins installed on both ends of the shaft move away from the center (extended), and the coupler has a coupling position of the attachment in which the locking pins are extended and the outer parts are engaged with the locking holes of the protrusions. Likewise, when users turn the shaft in the other direction, for example counter-clockwise, locking pins installed on both ends of the shaft move toward the center (shortened), and the coupler has a release position of the attachment in which the locking pins are shortened and the outer parts are released from the locking holes of the protrusions.

It is preferable that the shaft has a driving section with a polygonal cross-section in order to enable users to turn the shaft easily by using appropriate means such as a wrench.

It is preferable that the threads formed at the shafts and the locking pins are multiple start threads which provide bigger screw pitch so that the lead per rotation can be increased, which can consequently minimize the effort of users when turning the shaft.

The coupler of the present disclosure enables users to couple or uncouple the attachment by one touch turning operation, thus reducing the effort of users and saving time at work sites.

DRAWINGS

DETAILED DESCRIPTION

Reference will now be made in detail to embodiments of the present disclosure, examples of which are illustrated in the accompanying drawings. While the present disclosure will be described in conjunction with the following embodiments, it will be understood that they are not intended to limit the present disclosure to these embodiments alone. On the contrary, the present disclosure is intended to cover alternatives, modifications, and equivalents which may be included within the spirit and scope of the present disclosure as defined by the appended claims. Furthermore, in the following detailed description of the present disclosure, numerous specific details are set forth in order to provide a thorough understanding of the present disclosure. However, embodiments of the present disclosure may be practiced without these specific details.

Figure 1:
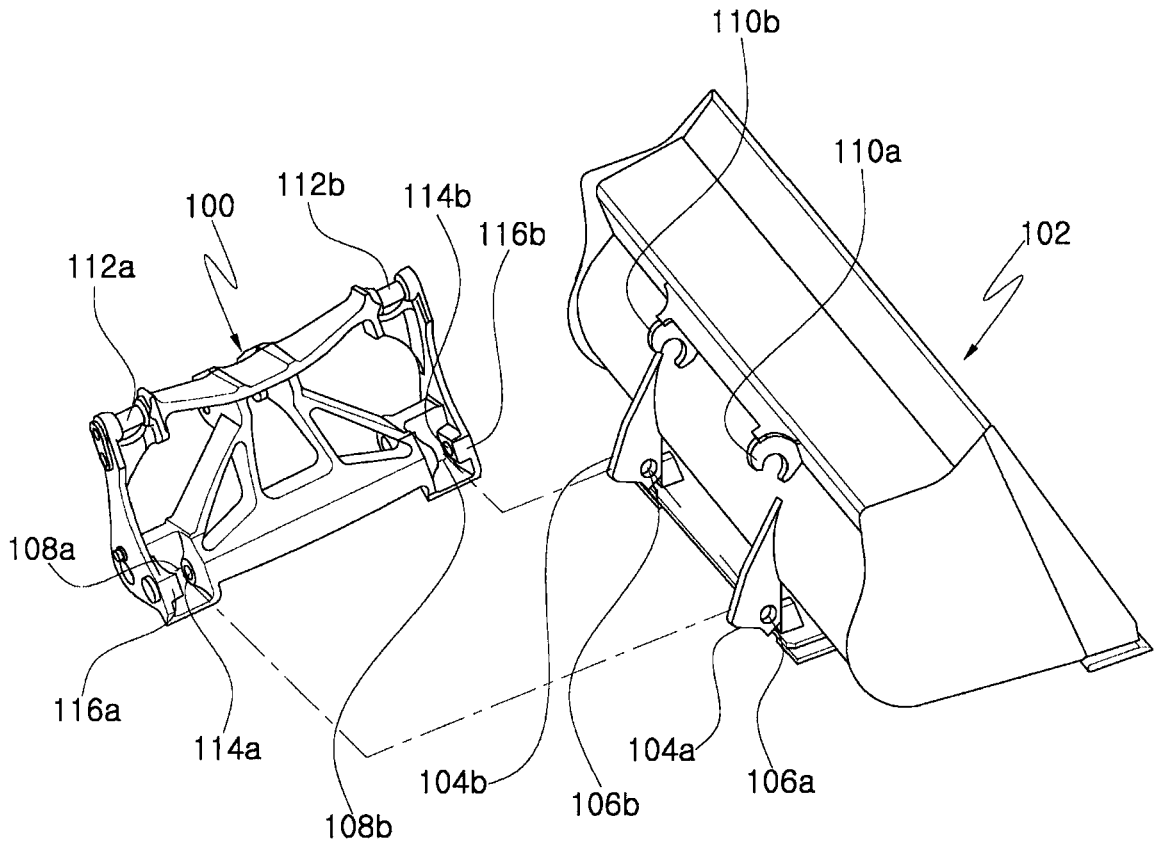
FIG. 1 is a perspective view of the coupler and the attachment according to one embodiment of the present disclosure.

FIG. 1 shows a perspective view of a bracket 100 and an attachment 102 according to one embodiment of the present disclosure. Bracket 100 has a back face pivotally connected to the free end of a lifting arm (not shown) of a wheel loader and a front face detachably connected to attachment 102.

Throughout the entire description and claims, the wheel loader is an example of the working machine to which the coupler of the present disclosure applies. Therefore, it should be understood that this coupler can apply to various kinds of working machine which has a detachable and interchangeable tools as an attachment. Some examples of such working machine are wheel loaders, track loaders, excavators, and dozers. Likewise, the bucket is an example of the attachment to which the coupler of the present disclosure applies. It should be understood that this coupler can apply to various kinds of attachment, for example, a clamp, a fork, a breaker or a crusher.

Attachment 102 has a pair of hooks 110*a*, 110*b* rearwardly extending from the upper back of attachment 102 and laterally spaced apart from each other. Bracket 100 has a pair of cross bars 112*a*, 112*b* installed at the upper front of bracket 100. When coupling attachment 102 to bracket 100, users bring attachment 102 to bracket 100 and have hooks 110*a*, 110*b* engaged with cross bars 112*a*, 112*b*.

Attachment 102 has a pair of protrusions 104*a*, 104*b*. Protrusions 104*a*, 104*b* are rearwardly extended from the lower back of attachment 102 and laterally spaced apart from each other. Protrusions 104*a*, 104*b* have locking holes 106*a*, 106*b* pierced through their width. Bracket 100 has a pair of receiving slots 108*a*, 108*b*. Receiving slots 108*a*, 108*b* are formed at the lower front of bracket 100 and engaged with protrusions 104*a*, 104*b*.

Figure 2:
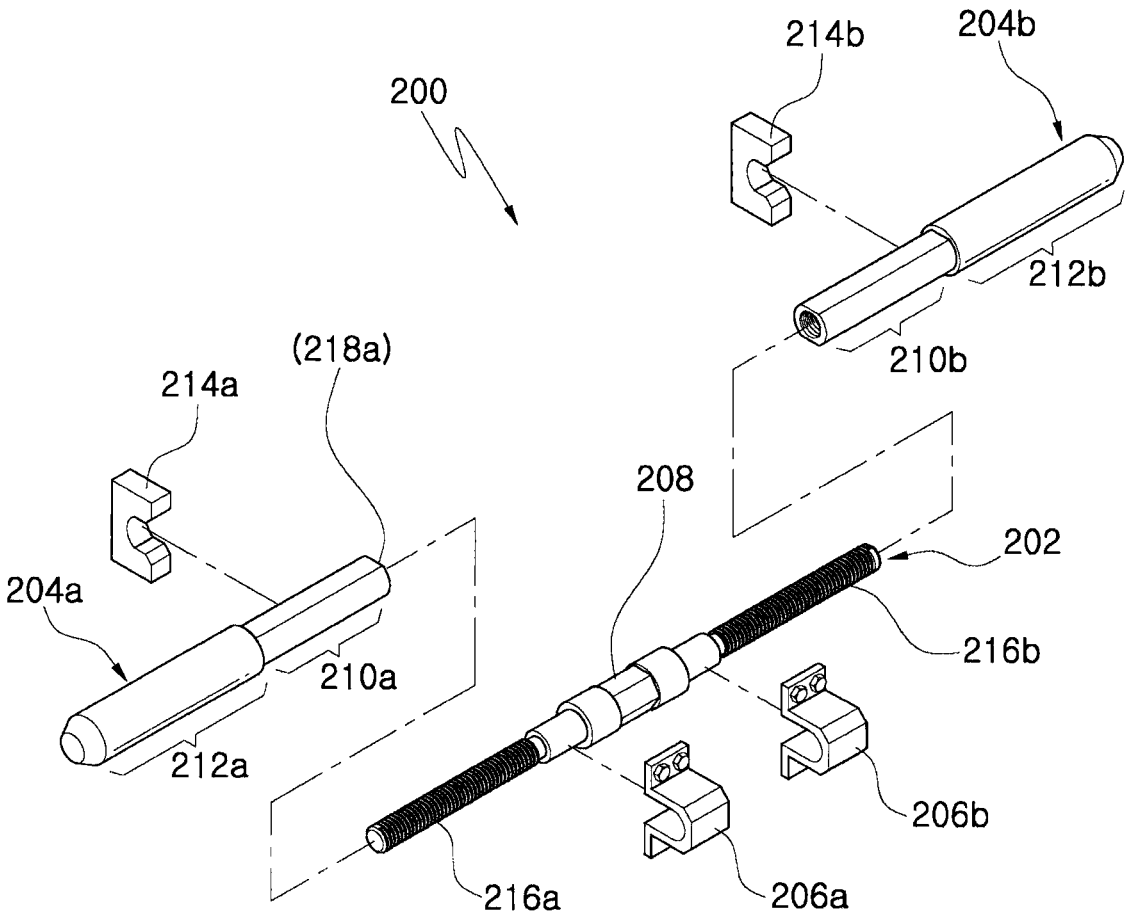
FIG. 2 is a disassembled perspective view of the coupler according to one embodiment of the present disclosure.

FIG. 2 shows a disassembled perspective view of a coupler 200 according to the embodiment of the present disclosure.

The coupler 200 comprises a shaft 202 and a pair of tubular locking pins 204*a*, 204*b* combined with shaft 202 by threads.

Shaft 202 has threads 216*a*, 216*b* formed at both ends. The threads formed at the one end of shaft 202(216*a*) are "right handed" and the threads formed at the other end of shaft 202(216*b*) are "left handed". Locking pins 204*a*, 204*b* are, at least partially, tubular and inserted into the ends of shaft 202, respectively.

The inside of the first tubular locking pin 204*a* has threads 218*a* corresponding to the threads 216*a* formed at the one end of shaft 202. Likewise, the inside of the second tubular locking pin 204*b* has threads 218*b* corresponding to the threads 216*b* formed at the other end of shaft 202.

The first locking pin 204*a* is longitudinally divided into two parts, that is, a cylindrically cross-sectioned outer part 212*a* and a non-cylindrically cross-sectioned inner part 210*a*. The cross-section of inner part 210*a* can be shaped into a partially flattened cylindrical shape or a polygonal shape.

Likewise, the second locking pin 204*b* is longitudinally divided into two parts, that is, a cylindrically cross-sectioned outer part 212*b* and a non-cylindrically cross-sectioned inner part 210*b*. The cross-section of inner part 210*b* can be shaped into a partially flattened cylindrical shape or a polygonal shape.

A pair of holders 214*a*, 214*b* are provided to support corresponding locking pins 204*a*, 204*b*, respectively. Holders 214*a*, 214*b* are fixed to bracket 100.

The contacting surface of the first holder 214*a* corresponds to the non-cylindrical contour of the inner part 210*a* of the first locking pin 204*a*. Therefore, the first locking pin 204*a* is prevented from being rotated when shaft 202 is driven to rotate. In other words, the first locking pin 204*a* is rectilinearly moved due to a thread interaction when shaft 202 rotates.

Likewise, the contacting surface of the second holder 214*b* corresponds to the contour of the inner part 210*b* of the second locking pin 204*b*. Therefore, the second locking pin 204*b* is prevented from being rotated when shaft 202 is driven to rotate. In other words, the second locking pin 204*b* is rectilinearly moved due to a thread interaction when shaft 202 rotates.

It is preferable that the longitudinal lengths of inner parts 210*a*, 210*b* are longer than or at least equal to the rectilinear moving strokes of locking pins 204*a*, 204*b* along shaft 202 so that the rotations of locking pins 204*a*, 204*b* are prevented throughout the entire strokes of locking pins 204*a*, 204*b*.

Figure 3A:
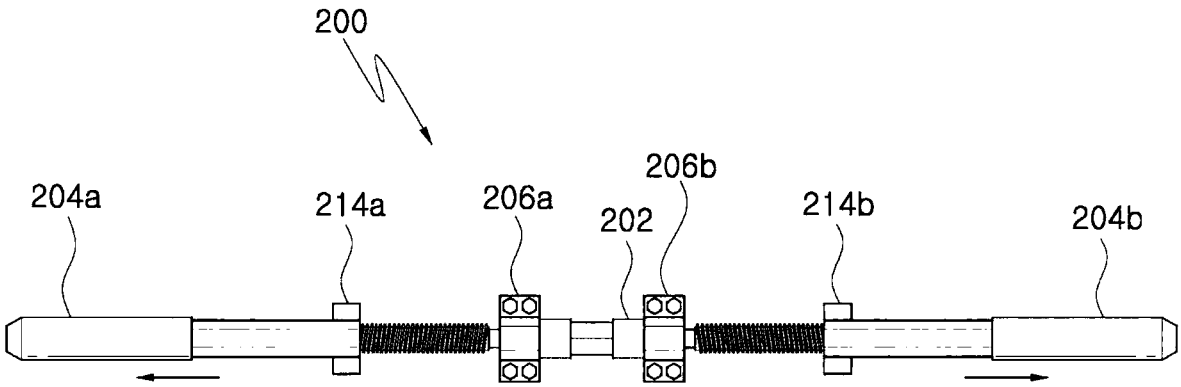
FIG. 3A shows the coupler in its coupling position where the locking pins are fully extended.

When users turn shaft 202 in one direction, e.g., clockwise, locking pins 204*a*, 204*b* move away from the center (extended), and the coupler 200 has a coupling position of the attachment in which locking pins 204*a*, 204*b* are extended and their outer parts 212*a*, 212*b* are engaged with locking holes 106*a*, 106*b* of protrusions 104*a*, 104*b*. FIG. 3A shows this coupling position where locking pins 204*a*, 204*b* are fully extended.

Figure 3B:
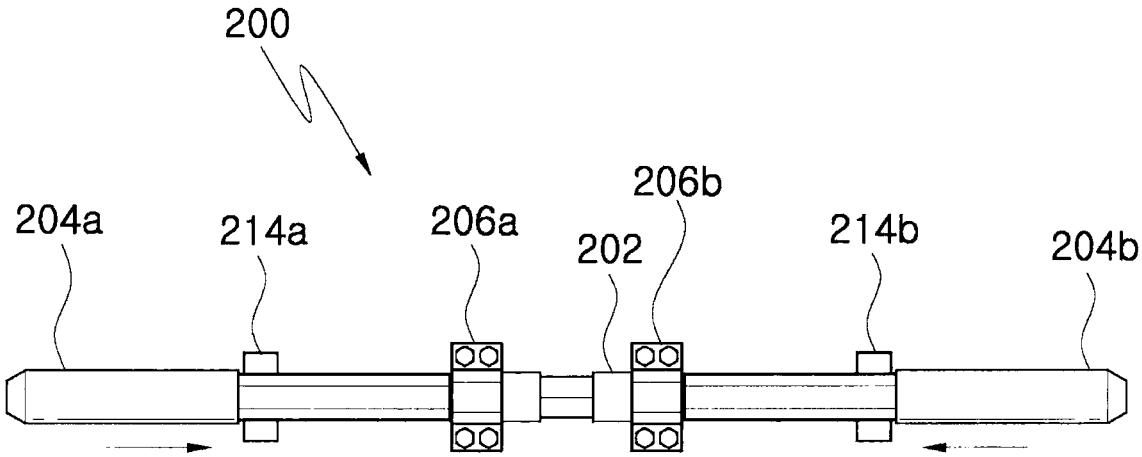
FIG. 3B shows the coupler in its release position where the locking pins are fully shortened.

Likewise, when users turn shaft 202 in the other direction, e.g., counter-clockwise, locking pins 204*a*, 204*b* move toward the center (retracted), and the coupler 200 has a release position of the attachment in which locking pins 204*a*, 204*b* are shortened and their outer parts 212*a*, 212*b* are released from locking holes 106*a*, 106*b* of protrusions 104*a*, 104*b*. FIG. 3B shows this release position where locking pins 204*a*, 204*b* are fully shortened.

It is preferable that the threads 216*a*, 216*b* of shaft 202 and the threads 218*a*, 218*b* of locking pins 204*a*, 204*b* are multi start threads. The multi start threads increase the lead per rotation of locking pins 204*a*, 204*b*. Accordingly, locking pins 204*a*, 204*b* can have longer rectilinear moving strokes relative to the rotation of shaft 202. In this embodiment, quadruple start threads are used. Consequently, these multiple start threads minimize the effort of users when turning the shaft.

It is preferable that shaft 202 has a driving section 208 with a polygonal cross-section in order to enable users to turn shaft 202 easily by using an appropriate tool such as a wrench. In this embodiment, the cross-section of driving section 208 is shaped as hexagonal, and a hexagonal wrench is used to turn shaft 202.

Figure 4:
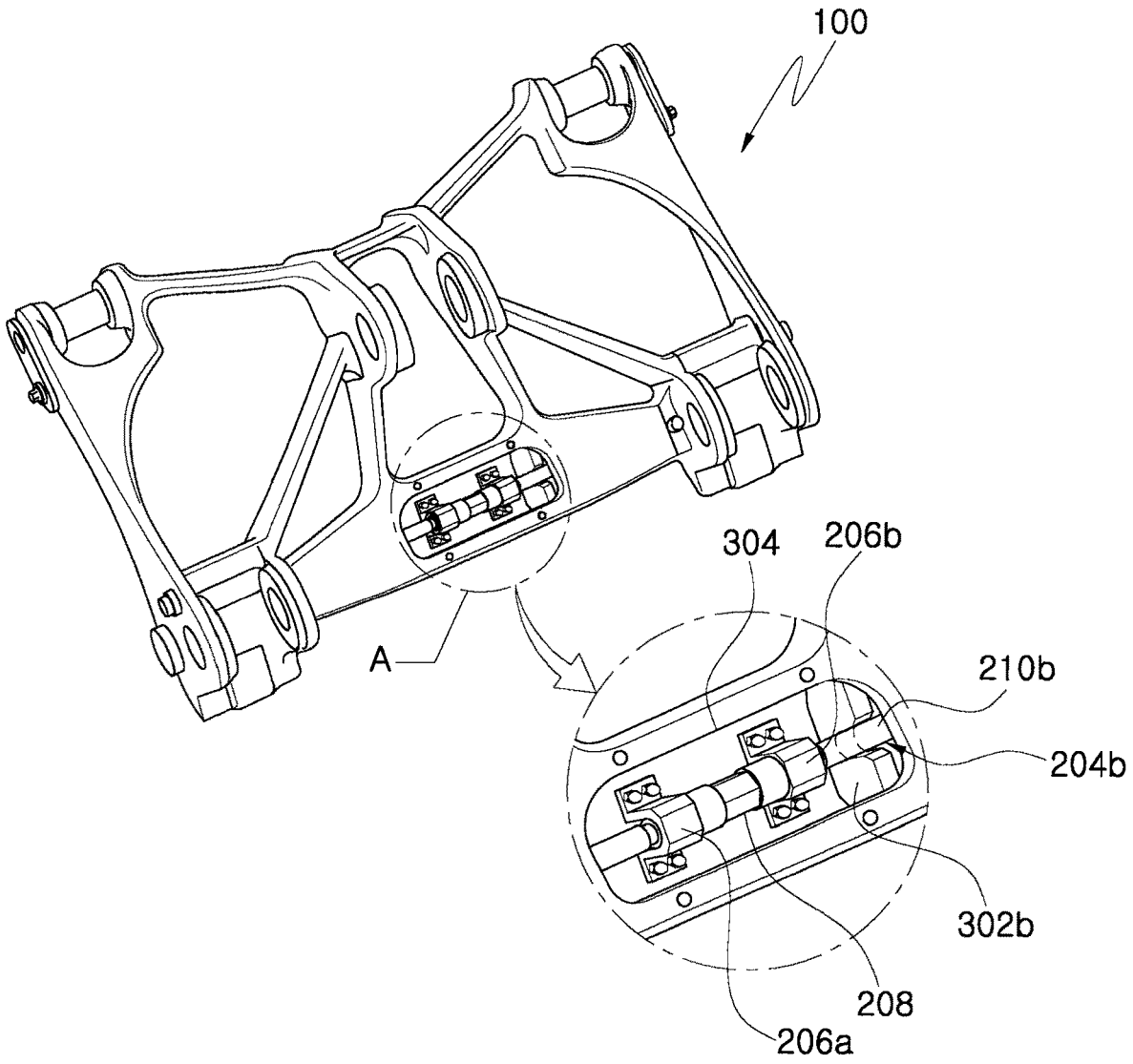
FIG. 4 is a perspective view of the bracket seen from the lifting arm side and an enlarged view of part "A"

FIG. 4 shows a perspective view of bracket 100 of the embodiment of the present disclosure seen from a lifting arm side, i.e., the back face of bracket 100 and an enlarged view of part "A".

Referring to FIG. 4, reference numerals 206*a*, 206*b* are fixtures used to affix shaft 202 to bracket 100. Fixtures 206*a* and 206*b* wrap around shaft 202 at the right side and at the left side of driving section 208, respectively, in a less frictional manner and bolted to bracket 100 at their edges.

An anti-friction material or coating (not shown) can be used on the contacting surfaces between fixtures 206*a*, 206*b* and shaft 202.

Bracket 100 has an opening 304 in order to allow users to access to drive section 208 of shaft 202 with a wrench.

According to the turning direction of shaft 202, coupler 200 has a coupling position of the attachment in which locking pins 204*a*, 204*b* are extended and engaged with locking holes 106*a*, 106*b*, and a release position of the attachment in which locking pins 204*a*, 204*b* are shortened and released from locking holes 106*a*, 106*b*.

Referring back to FIG. 1, reference numerals 114*a*, 114*b* are apertures formed at the outer walls 116*a*, 116*b* of receiving slots 108*a*, 108*b*. These apertures 114*a*, 114*b* secure the end of locking pins 204*a*, 204*b* in the coupling position of the attachment. Apertures 114*a*, 114*b* can be replaced with indentations in which the end of locking pins 204*a*, 204*b* would not be exposed from the outer walls 116*a*, 116*b*.

According to the embodiment described above, users can achieve coupling or uncoupling the attachment to the machine by simply turning the shaft in one direction or the other. Such a one touch operation provided by the embodiment minimizes the effort of users for coupling/uncoupling the attachment and saves time at work sites.

Figure 5:
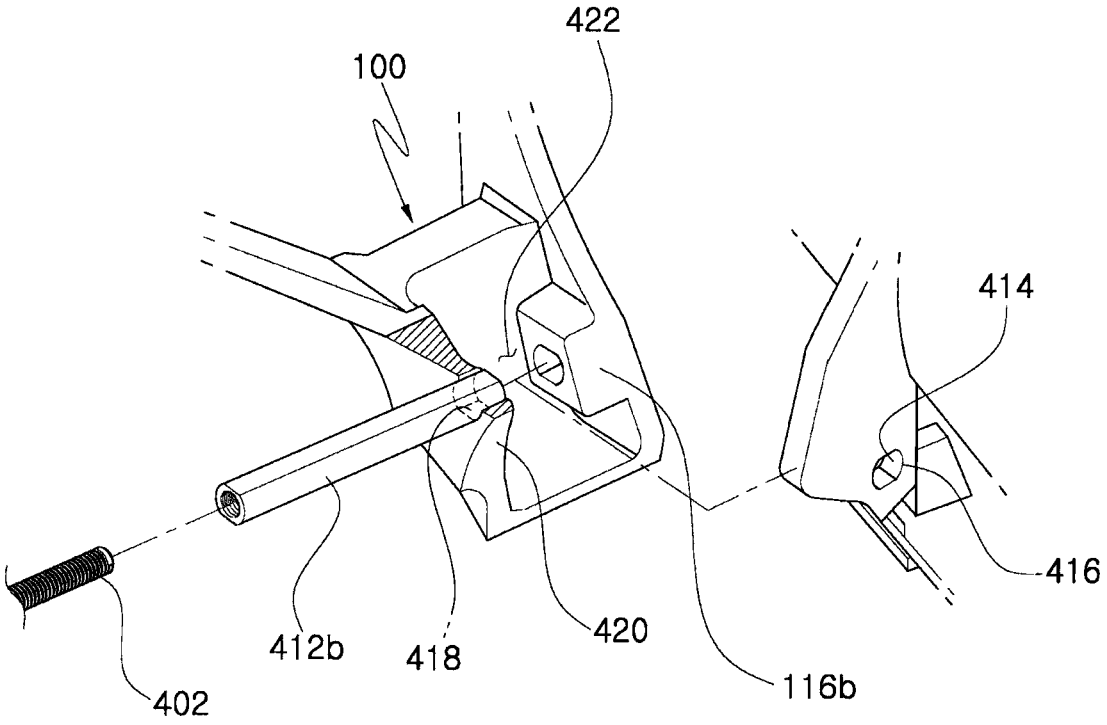
FIG. 5 is a disassembled perspective view of the coupler according to another embodiment of the present disclosure.

FIG. 5 shows a disassembled perspective view of a coupler according to another embodiment of the present disclosure.

FIG. 5 shows only a locking pin 412*b* of a pair of locking pins and doesn't show the opposite locking pin. However, the opposite locking pin has a same structure and function as locking pin 412*b*, so it can be understood without additional details.

In this embodiment, the cross-sections of locking pin 412*b* are non-cylindrical along their entire lengths or at least along their outer parts that are subject to be engaged with the locking holes of the protrusions. The cross-sections of this locking pin 412*b* can be shaped into a partially flattened cylindrical shape or a polygonal shape.

In this embodiment, the contacting surface 414 of the locking hole 416 of the protrusion correspond to the contour, i.e., the non-cylindrical cross-sections, of locking pin 412*b*, thereby preventing locking pin 412*b* from being rotated when it is inserted into locking hole 416. The contacting surfaces of aperture 418 formed at inner wall 420 of receiving slot 422 are also corresponding to the contour, i.e., the non-cylindrical cross-sections, of locking pin 412*b*. By this configuration, locking pin 412*b* is rectilinearly moved due to a thread interaction when shaft 402 rotates without the need of such holders shown in the first embodiment of the present disclosure.

Although the invention has been described with reference to the preferred embodiments in the attached figures, it is noted that equivalents may be employed and substitutions made herein without departing from the scope of the invention as recited in the claims.

The invention claimed is:

1. A coupler for detachably connecting an attachment to the free end of a lifting arm on a wheel loader, comprising:

a bracket with a back face pivotally connected to said lifting arm and a front face detachably connected with said attachment;

a first and a second protrusions rearwardly extending from the lower back of said attachment and laterally spaced apart from each other, said first protrusion having a first locking hole pierced through its width and said second protrusion having a second locking hole pierced through its width;

a first and a second receiving slots formed at the lower front of said bracket and engaged with said first protrusion and said second protrusion, respectively;

a shaft which has threads formed at both ends and installed at the lower part of said bracket, wherein the threads formed at the one end of said shaft are right handed and the threads formed at the other end of said shaft are left handed;

a first locking pin having an outer part configured to engage the first locking hole, the first locking pin having an inner part which has threads corresponding to the threads formed at the one end of said shaft, a cross-section of said first locking pin being a non-cylindrical shape, a contacting surface of said first locking hole with said first locking pin corresponding to said non-cylindrical shape of said first locking pin;

a second locking pin having an outer part configured to engage the second locking hole, the second locking pin having an inner part which has threads corresponding to the threads formed at the other end of said shaft, a cross-section of said second locking pin being a non-cylindrical shape, a contacting surface of said second locking hole with said second locking pin corresponding to said non-cylindrical shape of said second locking pin; and wherein said coupler has a coupling position of the attachment in which said locking pins are extended and engaged with said locking holes of said protrusions as said shaft rotates in one direction, and a release position of the attachment in which said locking pins are shortened and released from said locking holes of said protrusions as said shaft rotates in the other direction.

2. The coupler of claim 1, wherein:

the cross-section of said first locking pin is partially flattened cylindrical shape; and the cross-section of said second locking pin is partially flattened cylindrical shape.

3. The coupler of claim 1, wherein:

the cross-section of said first locking pin is polygonal shape; and the cross-section of said second locking pin is polygonal shape.

4. The coupler of claim 1, wherein:

said first locking pin is tubular and said threads of said first tubular locking pin are formed at the internal surface of said first tubular locking pin; and said second locking pin is tubular and said threads of said second tubular locking pin are formed at the internal surface of said second tubular locking pin.

5. The coupler of claim 1, wherein:

said threads formed at said shafts and said locking pins are multi start threads, whereby the lead per rotation is increased.

6. The coupler of claim 1, wherein said shaft further comprising:

a driving section with a polygonal cross-section.

7. The coupler of claim 6, further comprising:

a first fixture wrapping around said shaft at the right side of said driving section and fixed to said bracket at its edges; and a second fixture wrapping around said shaft at the left side of said driving section and fixed to said bracket at its edges.

8. The coupler of claim 1, further comprising:

a fixture wrapping around said shaft and fixed to said bracket at its edges.

* * * * *